United States Patent [19]

Cherouge

[11] 4,264,948

[45] Apr. 28, 1981

[54] BEACON LAMP WHICH EMITS A CONICAL BEAM

[75] Inventor: Dominique Cherouge, Le Vaudreuil Ville Nouvelle, France

[73] Assignee: Compagnie Industrielle des Piles Electriques "Cipel", Levallois-Perret, France

[21] Appl. No.: 30,057

[22] Filed: Apr. 13, 1979

[30] Foreign Application Priority Data

Apr. 24, 1978 [FR] France ..... 78 12031
Apr. 24, 1978 [FR] France ..... 78 12032

[51] Int. Cl.[3] ..... F21V 5/04
[52] U.S. Cl. ..... 362/311; 362/335
[58] Field of Search ..... 362/62, 63, 311, 326, 362/330, 332, 333, 334, 335, 336, 337, 338, 339, 340, 455, 456

[56] References Cited

U.S. PATENT DOCUMENTS

| | | | |
|---|---|---|---|
| 1,139,395 | 5/1915 | Armantage et al. | 362/333 |
| 1,495,521 | 5/1924 | Kopp | 362/334 |
| 2,021,611 | 11/1935 | Rolph . | |
| 2,254,961 | 9/1941 | Harris | 362/336 |
| 2,310,600 | 2/1943 | Robinson | 362/334 |
| 2,352,801 | 7/1944 | Rolph . | |
| 3,886,347 | 5/1975 | Dorman | 362/311 |
| 4,086,483 | 4/1978 | Freund et al. | 362/311 |
| 4,161,770 | 7/1979 | Maurer | 362/62 |

FOREIGN PATENT DOCUMENTS 698128 10/1953 United Kingdom .

*Primary Examiner*—L. T. Hix
*Assistant Examiner*—Alan Mathews
*Attorney, Agent, or Firm*—Kenyon & Kenyon

[57] ABSTRACT

The invention relates to a beacon lamp which includes a substantially point source of light F surrounded by a transparent cap (1) which forms a lens (8). In accordance with the invention, said lens is chosen so that the emerging beam (9) occupies the nappe or sheet of a cone (10) having its apex at F. Application to air spotting survivors at sea of an air crash or a ship wreck, the survivors being equipped for example with life jackets including such lamps.

2 Claims, 3 Drawing Figures

BEACON LAMP WHICH EMITS A CONICAL BEAM

The invention relates to beacon lights such as are used for indicating the location of survivors at sea of shipwrecks of air crashes, said devices being suitable for equipping life jackets on board aircraft.

Known devices of this type include a substantially point source F of light surrounded by a transparent cap which forms an annular lens suitable for concentrating at least part of the light emitted by the source into a plane perpendicular to a straight line z'z which passes through the source F. The source of light is usually the filament of an incandescent lamp which may be fed with electric current, when required, by an electric cell which may be of a kind which is activated by sea water.

The beam directed by the lens of such a device is visible to an observer placed anywhere in the plane perpendicular to the axis z'z which passes through F or in the vicinity of the plane. Since this plane is normally horizontal when the survivor floats on the sea, the lamp allows him to be spotted by ships patrolling in the vicinity.

Searches for survivors at sea are also made by aircraft. Now, known beacon lamps do not provide significant upward concentration of light or concentrate only a very small part of the rays emitted in a substantially vertical direction. These lamps are therefore practically ineffective for spotting survivors from aircraft.

The invention aims to produce an effective beacon lamp for spotting shipwrecked survivors.

The invention provides a beacon lamp which includes a substantially point source of light F surrounded by a transparent cap wherein the cap forms at least one lens suitable for concentrating part of the light emitted by the source into a beam which substantially occupies a diverging nappe or sheet having its apex at the point F.

If the axis z'z is vertical and the lamp is the right way up, light from the light source will be concentrated upwards in a generally conical nappe or sheet of light spreading upwards from the light source. Therefore, if an aircraft passes approximately vertically above the survivor, it will pass twice through regions of concentrated light.

If the half angle a at the apex of the nappe or sheet is the same in all directions about the axis z'z the concentrated light beam will occupy the nappe of a right circular cone which is symmetrical about the axis z'z. Otherwise the light may occupy a pyramid shape or an upwardly spreading shape of irregular cross-section.

Two embodiments of the invention are described by way of example with reference to the accompanying drawing in which.

Figure 1:
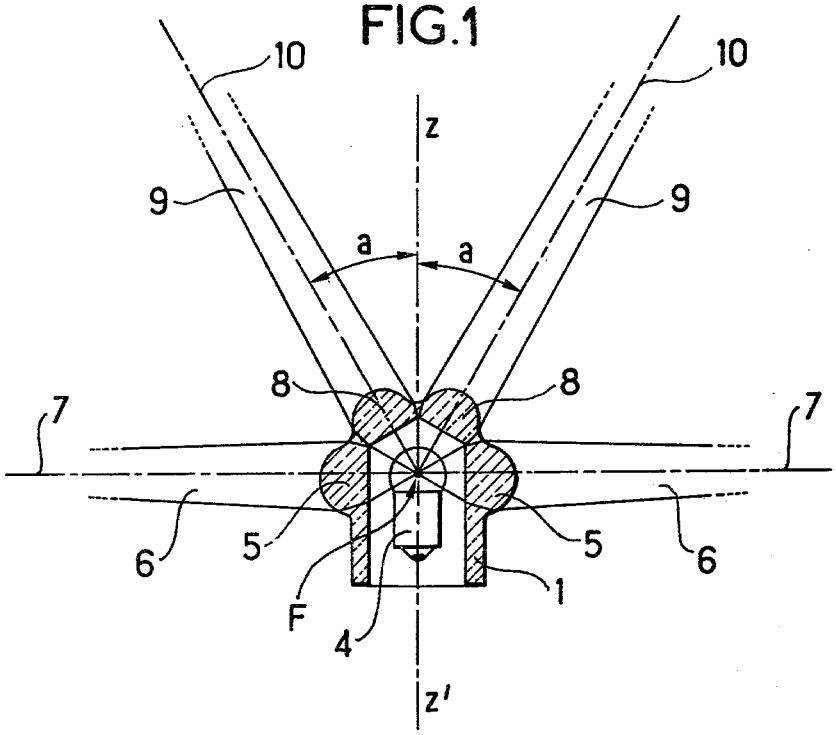
FIG. 1 is a cross-section through part of a first beacon lamp embodying the invention.

In FIG. 1 an incandescent light bulb 4 has a filament constituting a point source of light F, and a transparent cap 1 which is shown in cross-section. The cap 1 is in the form of a solid of revolution whose axis z'z passes through the source F of light of the light bulb 4. In the complete lamp, the cap and the light bulb are fixed on a support and the light bulb is connected to a source of electric current such as a cell which is activated by sea water. When the light bulb 4 is lit, an annular lens 5 formed in the cap 1 concentrates part of the light emitted by the source F into a beam 6 occupying a plane 7 which passes through the source F and which is perpendicular to the axis z'z. A straight line illustrates the plane 7 in the figure. The concentrated beam 6 is substantially uniform in all directions about the axis z'z (although it is not strictly so since the filament F is not a perfect point). In operation it shines in all the directions of the plane 7, which is then substantially horizontal.

In accordance with the invention, another lens 8 of the cap 1 concentrates a further part of the light which comes from the source F in a beam 9 into the nappe or sheet of a right circular cone 10 about the axis z'z with an acute half angle a at its apex (the point F). The concentrated beam 9 emits light upwards in all directions about the axis z'z. Consequently, any aircraft travelling at such a distance from the axis z'z that the line between the lamp and the aircraft forms an angle of less than a with the axis z'z will cross the beam twice.

The lens 8 such as illustrated has an inside surface which is conical; i.e. a surface of revolution about the axis z'z with a rectilinear generatrix. The outside surface of the lens 8 is convex and is likewise a surface of revolution about the axis z'z; its generatrix is a portion of a curve such as an arc of a circle. The shape of these surfaces does not form a part of the invention and can be chosen so as to provide maximum concentration of the beam 9.

Figure 2:
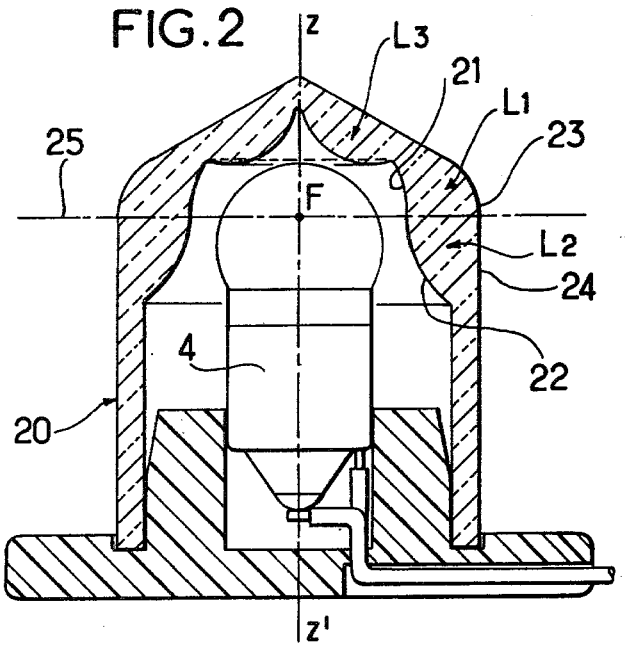
FIG. 2 is a cross-section through a second beacon lamp embodying the invention.
Figure 3:
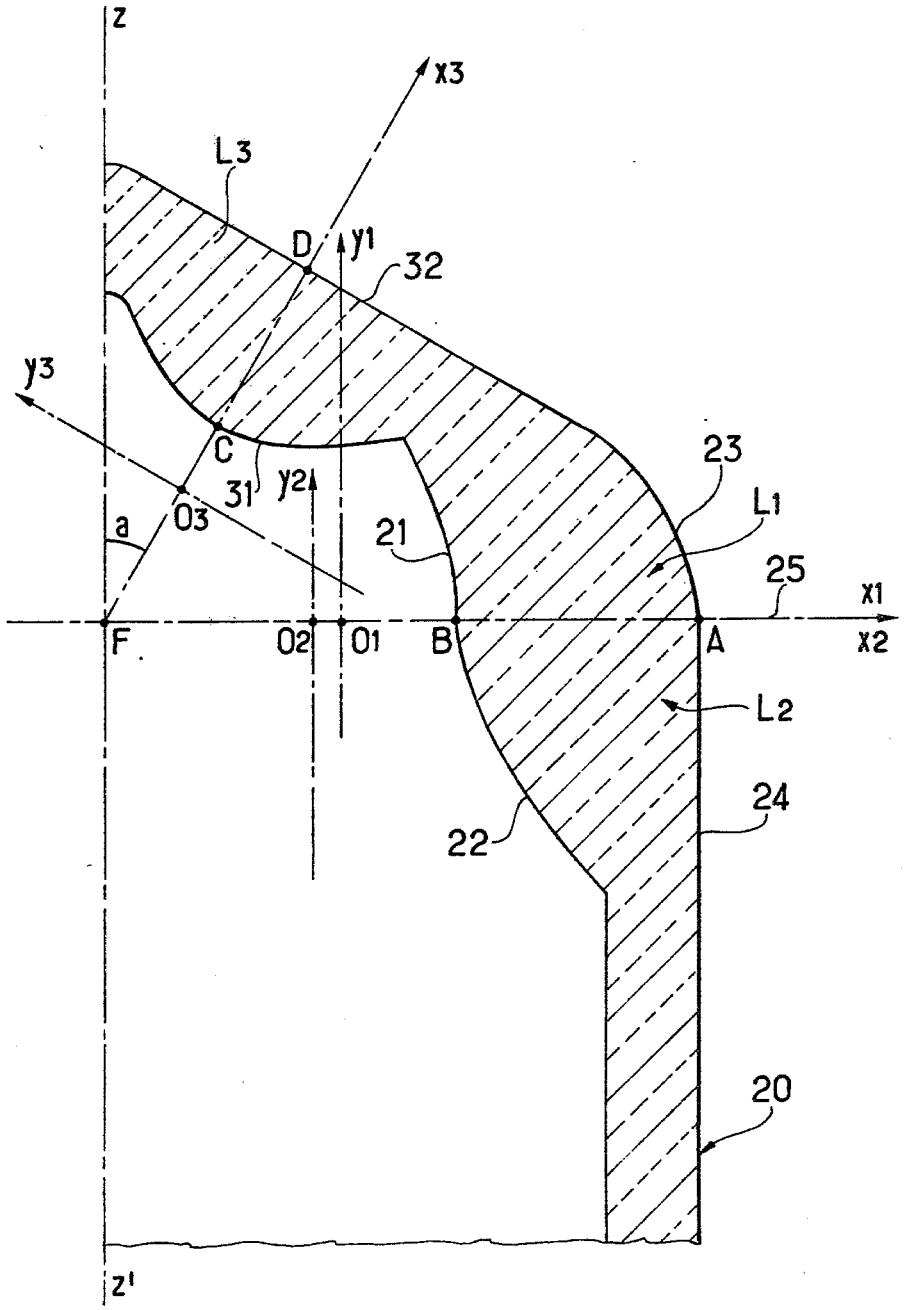
FIG. 3 is a cross-section through part of the beacon lamp of FIG. 2 on a larger scale.

FIGS. 2 and 3 show an example of a different shape of cap which, nevertheless, provides adequate concentration for an upwardly directed beam. The details of the shape of the lamp of FIGS. 2 and 3 constitute the subject matter of the inventor's copending patent application of the same date, which is concerned with providing a cap of a shape that is easy to mould.

The lamp illustrated in FIG. 2 includes a cap 20 made of a transparent plastics material, in the form of a body of revolution about an axis zz', said cap containing the bulb 4 whose filament is located at a point F. A plane perpendicular to zz' and passing through F is referenced 25. The cap 20 includes an annular lens which has two zones L1 and L2 situated respectively on either side of the plane 25, and which performs the same function as the lens 5 of FIG. 1.

In cross-section, as shown in FIGS. 2 and 3, the zone L1 of the lens has a concave inner surface 21 and a convex outer surface 23. Likewise the zone L2 has a convex inner surface 22 and an outer surface 24 of rectilinear section. The cap is closed with a third lens zone L3 which performs the same function as the lens 8 of FIG. 1. It is clear that the cap can be moulded without requiring a flash line running around the annular lens. This ease of moulding would still be possible if the concave inner surface 21 of the zone L1 were replaced by a surface of rectilinear section and/or if the outer surface 24 of the zone L2 were replaced by a concave surface.

Advantageously, so as to lose as little as possible of the light which emerges in the vicinity of the plane 25, the generatrices of the surfaces 21, 22, 23 and 24 are chosen so as to be anastigmatic between the point F and infinity, i.e. so as to produce an emerging beam which is parallel to the plane 25 in all directions about the axis zz'.

FIG. 3 illustrates, on an enlarged scale, a solution which provides anastigmatism in the lens zones L1 and L2.

Hereinafter, the following references will be used:

n for the refractive index of the material of which the cap 20 is made;

A and B for the points where the axis 25 intersects the outer and the inner surfaces respectively of the cap 20;

R for the distance FA; and r for the distance FB.

The values of n, R and r are fixed a priori.

The generatrix of the surface 23 is defined in a system of axes $O_1x_1$, $O_1y_1$, where $O_1x_1$ lies in the plane 25, and the point $O_1$ is such that $FO_1=R/(n+1)$. The generatrix of the surface 23 is a portion of an ellipse whose equation is:

$$\frac{x_1^2(n+1)^2}{R^2n^2}+\frac{y_1^2(n+1)}{R^2(n-1)}=1$$

Further, the generatrix of the surface 22 is defined in a system of axes $O_2x_2$, $O_2y_2$, where $O_2x_2$ lies in the plane 25, and the point $O_2$ is such that $FO_2=rn/n+1$. The generatrix of the surface 22 is a portion of a hyperbola whose equation is:

$$\frac{x_2^2(n+1)^2}{r^2}-\frac{y_2^2(n+1)}{r^2(n-1)}=1$$

The generatrix of the surface 21 lies on a portion of a circle whose centre is F and whose radius is r and the generatrix of the surface 24 is a portion of a straight line which passes through A and is perpendicular to the plane 25.

The lens zones L1 and L2 are therefore completely defined. The light which comes from F and strikes the zone L1 is not deviated by the optical surface 21; it leaves the optical surface 23 exactly parallel to the plane 25, since the latter surface is exactly anastigmatic for the point F and infinity. The light which comes from F and strikes the zone L2 emerges from the surface 22 parallel to the plane 25, since the latter surface is exactly anastigmatic for the point F and infinity; this light is travelling orthogonally to the outer surface 24 and is not deviated thereby.

It is observed that the thickness AB may be very much less than the thickness of the lens illustrated in FIG. 1. This results in a reduction in weight, which is important when a large number of such beacon lamps are to be loaded on board an aircraft, and further improves moulding conditions for the lamp.

Lastly, the cap illustrated in FIG. 3 includes an upper lens zone L3 which is a body of revolution about the axis zz' and is delimited by an inner optical surface 31 which is convex in section and by an outer optical surface 32 which is conical. The generatrix of the surface 31 is of the same type as the generatrix of the surface 22, and it is a hyperbola referenced in a system of axes $O_3x_3$, $O_3y_3$, where $O_3x_3$ forms an angle a with the axis zz' and intersects the lens zone L3 at two points C and D. The generatrix of the surface 32 is rectilinear and perpendicular to $O_3x_3$.

The lens zone L3 is anastigmatic for the point F and infinity and concentrates light striking the zone L3 from the point in the nappe or sheet of a cone whose apex is at F and whose half angle at the apex is equal to a. The conical surface in which the beam is concentrated is useful for aircraft spotting of survivors at sea.

The invention is not limited to the use of a cap which has circular symmetry nor to obtaining an ascending beam with circular symmetry. If it is considered preferable, the cone about which the ascending beam is concentrated need not be circularly symmetrical. To obtain the advantages of the invention it is necessary only for the generatrices of the cone all to form an acute angle with the vertical axis z'z at the light source, in such a way that an aircraft which passes vertically over the beacon lamp or nearly vertically over it crosses the cone of concentrated light twice. Further, in the lamp in accordance with the invention, the lens 5 may be omitted if air spotting only is required. Alternatively, the cap may have a plurality of lenses by means of which it is possible to obtain several beams concentrated about the generatrices of cones with different acute angles a. An aircraft which passes above the device would then cross each beam twice. This increases the chances of its spotting the survivor.

I claim:

1. A beacon lamp including a substantially point source F of light and a transparent cap surrounding the light source and forming at least one lens adapted to direct part of the light rays emitted by the source into a beam distributed in all directions around an axis z'z passing through F, wherein the improvement comprises said cap forming a first annular lens adapted to concentrate part of the light rays emitted by the point source F into a first beam which substantially occupies a conical sheet generated by the rotation around axis z'z of a straight line originating at F and making at all times an acute angle with the axis z'z and a second annular lens adapted to concentrate another part of the light rays emitted by the point source F into a second beam which substantially occupies a plane which is perpendicular to the axis z'z and passes through F, the light rays in both said first and second beams being distributed in all directions around the axis z'z.

2. The beacon lamp of claim 1 wherein the acute angle of said first beam is constant in all directions around the axis z'z.

* * * * *